US005318182A

United States Patent [19]

Thorud et al.

[11] Patent Number: 5,318,182

[45] Date of Patent: Jun. 7, 1994

[54] STACKABLE AND REVERSIBLE TRAYS FOR STORING DRAWING SHEETS, PAPER STOCK, AND THE LIKE

[75] Inventors: Stanley R. Thorud; Richard K. Bergquist, both of New Hope; David J. Martin, Andover, all of Minn.

[73] Assignee: Liberty Diversified Industries, New Hope, Minn.

[21] Appl. No.: 804,121

[22] Filed: Dec. 6, 1991

[51] Int. Cl.[5] ..... B65D 1/34

[52] U.S. Cl. ..... 206/509; 220/626; 220/627

[58] Field of Search ..... 206/509; 220/604, 605, 220/606, 627, 626

[56] References Cited

U.S. PATENT DOCUMENTS

| | | | |
|---|---|---|---|
| 3,141,554 | 7/1964 | Sussman et al. . | |
| 3,259,269 | 7/1966 | Asenbauer | 206/509 |
| 3,342,346 | 9/1967 | Tucker . | |
| 3,478,892 | 11/1969 | Lockwood . | |
| 3,552,598 | 1/1971 | Wilson . | |
| 3,695,424 | 10/1972 | Cristy et al. | 206/509 |
| 3,791,528 | 2/1974 | Brendgord . | |
| 3,856,178 | 12/1974 | Norgaard | 220/608 |
| 3,918,781 | 11/1975 | Paris | 206/509 |
| 4,015,713 | 4/1977 | Clipson et al. | 206/509 |
| 4,167,232 | 9/1979 | Munk et al. | 206/509 |
| 4,333,573 | 6/1982 | Holoubek | 206/509 |
| 4,402,451 | 9/1983 | Woerz et al. | 206/509 |
| 4,442,969 | 4/1984 | Holden | 220/608 |

FOREIGN PATENT DOCUMENTS

| | | | |
|---|---|---|---|
| 873707 | 6/1971 | Canada . | |
| 1326961 | 4/1963 | France | 206/509 |
| 361239 | 9/1957 | Switzerland | 206/509 |
| 1146029 | 3/1969 | United Kingdom | 206/509 |

*Primary Examiner*—Joseph Man-Fu Moy
*Attorney, Agent, or Firm*—Moore & Hansen

[57] ABSTRACT

A stackable tray for paper stock, drawings sheets, or the like comprising a bottom panel, opposing side walls extending upwardly from the bottom panel along the side edges thereof, and front and walls extending upwardly from the bottom panel along the front and rear edges thereof. The front wall is comprised of a pair of spaced apart front wall segments defining an opening traversing substantially the length of the tray. The walls define a top ledge extending upwardly and a bottom ledge extending downwardly. The top and bottom ledges are sized and positioned so that the top ledge of one tray is received within and bounded by the bottom ledge of a like tray when the trays are stacked, or vice versa. The bottom panel defines a plurality of recesses aligned in rows and columns. A cross brace traverses each tray and is received within a recess formed in the underside of the bottom panel. The walls and bottom panel are molded to form inner and outer shell segments with a hollow cavity therebetween, with the lower shell segment of each square recess extending upwardly adjacent to the upper shell segment of the bottom panel. The trays may be stacked with the openings facing the same or opposing directions relative to one another. Each tray will support a large weight of paper stock without flexing or bending to obstruct the opening of a tray lower in the column, and without breaking or becoming dislodged.

14 Claims, 4 Drawing Sheets

STACKABLE AND REVERSIBLE TRAYS FOR STORING DRAWING SHEETS, PAPER STOCK, AND THE LIKE

BACKGROUND OF THE INVENTION

This invention relates generally to open stackable platform trays for storing drawing sheets, paper stock, and the like.

Various types of platform trays are known to the art, and are used as an alternative to flat files, tubes, lockers, and vertical slat cabinets for storing large drawings sheets, paper stock, and the like in a flat, generally horizontal planar orientation.

One type of stackable modular interlocking tray utilizing molded plastic body with steel reinforcing is known, and has been marketed under the name of Sort-A-System TM by the Fidelity Products Company. Each Sort-A-System TM tray was capable of holding paper sheets having dimensions up to 26" by 39¾", and provided an open front through which the paper sheets could be removed or replaced.

However, the Sort-A-System TM trays present significant limitations. Despite the steel reinforcement, the trays cannot support a large volume of paper stock without bending or collapsing. The trays are limited to a smaller and non-standard sized paper sheet, while most paper stocks are obtained and maintained in sizes up to 42" by 32". The rear and sides of the Sort-A-System TM trays are generally open, which permits dust to build up on paper stock if left unused for a significant time, and which can expose the paper stock to uneven or inconsistent light and cause bleaching or discoloration of portions of the stock. Moreover, the legs of the Sort-A-System TM trays used to interlock trays stacked in a column are formed separately from the tray bodies and affixed to the tray bodies during assembly, thus producing projections that extend outwardly from the lines of the trays and create obstacles to working around the column of trays, create weak points where the legs could separate from the tray bodies and be damaged, and also producing visual discontinuity and a less aesthetically pleasing appearance.

The weight of a volume of paper stock can be difficult to calculate unless the particular type of paper stock is designated. For example, a text paper may be termed a "basis 24" with a size of 17" by 22" (432 mm. by 559 mm.) This means that one ream of five hundred 17"×22" sheets of that stock will have a weight of 24 lbs. A similar weight text paper might be a "basis 80" with a sheet size of 25" by 38" (635 mm. by 965 mm.) In each case, the sheets may have different thicknesses so each ream of five hundred sheets has a different height, but each sheet has an effective density of 118 g/m2. That is, in the case of the basis 80 paper, each sheet has an area of 0.61 m2 and a weight of approximately 72.3 g., and a ream of five hundred such sheets would have a weight of approximately 36.15 kg. or 80 lbs. In contrast, a standard cover stock might be basis 100 with a sheet size of 25½" by 38" (648 mm. by 965 mm.), and have a sheet density of 270 g/m2.

When converting these designations to a standard large sheet size of 32" by 42" (813 mm. by 1067 mm.), it may be seen that a ream of the basis 80 text stock would weigh approximately slightly over 51 kg. or 112 lbs., and a ream of the cover stock would weigh slightly over 117 kg. or 257 lbs. The relative heights of each ream might be the same but are likely to be significantly different from one another.

BRIEF SUMMARY OF THE INVENTION

It is therefore one object of this invention to design a tray to contain drawings sheets or paper stock which may be stacked within a column of like trays.

It is a related object of this invention to design the above tray such that each tray within the column may contain relatively large volumes of heavy paper stock, and may hold paper stock in larger standard sizes.

In particular, it is an object of this invention to design the above tray such that each tray stacked in the column may receive and hold a stack of paper stock having a height of approximately 2" (50 mm.), with each sheet having width and length dimensions of approximately 32" by 42" (813 mm. by 1067 mm.), in text or cover paper stocks having sheet densities ranging up to and in some instances above 300 g/m2., such that each tray may hold between approximately 40 lbs. (18 kg.) of paper when stacked in a column of ten like trays) and approximately 75 lbs. (34 kg.) of paper when single without significant deflection of the bottom panel or obstruction of the front opening of like trays.

It is a further object of this invention to design the above tray such that it provides more sturdy and durable construction, and cleaner unobstructed lines, while being less expensive to manufacture and assemble than prior art trays.

It is an additional object of this invention to design the above tray such that any one tray in the column of like trays may be reversed in orientation, such that paper may be removed from either side of the column.

It is yet another object of this invention to design the above trays such that they enclose the drawings and paper stock contained therein to protect the drawings or paper stock from light and dust, but permitting unobstructed visibility of those drawings and paper stock from the front opening of those trays.

It is a related object of this invention to design the above trays such that the trays will not flex or bend downwardly in the area proximate to the front openings when a substantial volume and weight of paper stock is placed thereon.

It is a further object of this invention to design the above trays such that they provide for greater interlocking strength and balance integrity when several of the trays are stacked in the column.

Briefly described, the stackable tray of this invention includes a bottom panel, a pair of opposing side walls extending upwardly from the bottom panel along the side edges thereof, and a front wall and a rear wall extending upwardly from the bottom panel along the front and rear edges thereof. The front wall may be comprised of a pair of spaced apart front wall segments defining an open-topped opening traversing substantially the length of the tray and disposed between the front wall segments and above the bottom panel. Each of the side walls, rear wall, and front wall define a top ledge extending upwardly therefrom and a bottom ledge extending downwardly therefrom. The top and bottom ledges ar sized and positioned such that the top ledge of one tray is received within and bounded by the bottom ledge of a like tray when the trays are stacked on top of each other and nested, or such that the top ledge of the one tray receives and bounds the bottom ledge of the like tray when the trays are stacked and nested. The bottom panel defines a waffle pattern formed by a plurality of recesses aligned in generally parallel spaced-apart rows and columns. The trays may be stacked with the openings facing the same direction, or with the openings of selected trays facing in opposite directions relative to one another. Each tray will support a large weight of paper stock without flexing or bending to obstruct the opening of a tray lower in the column, and without breaking or becoming dislodged from the column. A cross brace traversing each tray is received within a recess formed in the underside of the bottom panel, and provides further support for the bottom panel proximate to the front opening. The walls and bottom panel are molded to form inner and outer shell segments with a hollow cavity therebetween, with the lower shell segment of each square recess of the waffle pattern extending upwardly adjacent to the upper shell segment of the bottom panel.

DESCRIPTION OF THE PREFERRED EMBODIMENTS

The stackable tray of this invention is shown in FIGS. 1-9 and referenced generally therein by the numeral 10.

Figure 1:
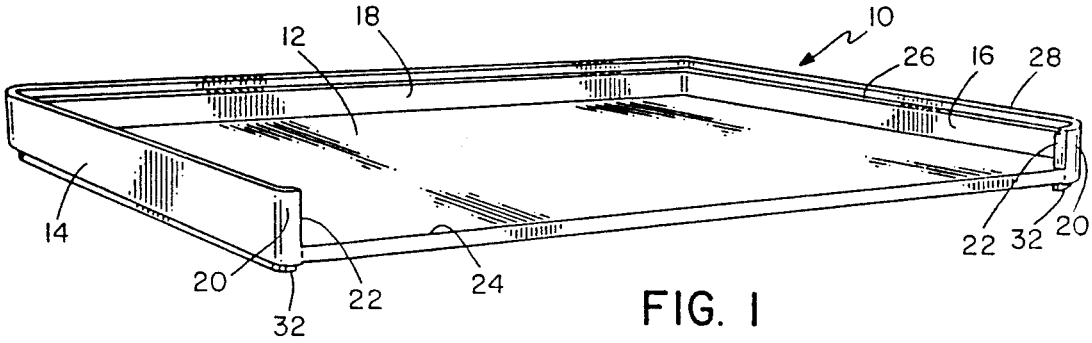
FIG. 1 is a front perspective view of a single stackable tray of this invention.
Figure 2:
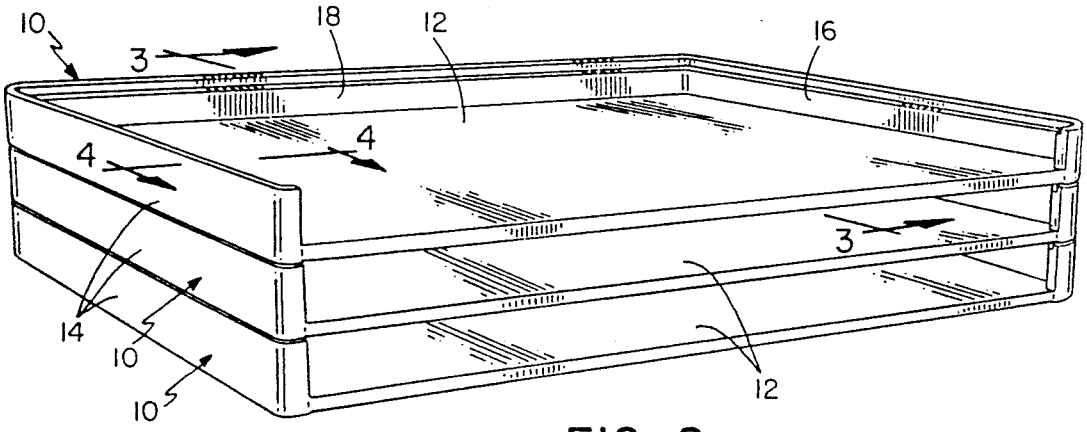
FIG. 2 is a front perspective view of a plurality of trays of FIG. 1 stacked in a vertical column with all like trays in the column facing forward.

Referring particularly to FIGS. 1 and 2, it may be seen that each tray 10 and like tray 10 has a generally planar bottom panel 12, a pair of opposing side walls 14, 16 integrally formed with and extending perpendicularly upward from the side peripheral edges of the bottom panel 12, and a rear wall 18 integrally formed with and extending perpendicularly upward from the rear peripheral edge of the bottom panel 12. A front wall 20 comprised of a pair of wall segments extending perpendicularly inward a short distance from the front edges of each of the side walls 14, 16 defines an opening 22 which traverses the length of the tray 10 and is bounded by the each of the wall segments forming the front wall 20 and the front edge 24 of the bottom panel 12. The front wall 20 may in some cases preferably include a bottom lip extending upwardly a short distance from the front edge 24 of the bottom panel 12 and traversing the length of the opening 22, or alternately the wall segments forming the front wall 20 may be omitted and the front of the tray 10 may be left completely open between the side walls 14, 16.

The distance between the inside surfaces of the opposing side walls 14, 16 is preferably approximately 42½", with the distance between the inside surfaces of the rear wall 18 and wall segments forming the front wall 20 being approximately 32½". The height of each side wall 14, 16, rear wall 18, and wall segment forming the front wall 20 measured from the top surface of the bottom panel 12 is preferably approximately 2½".

Figure 3:
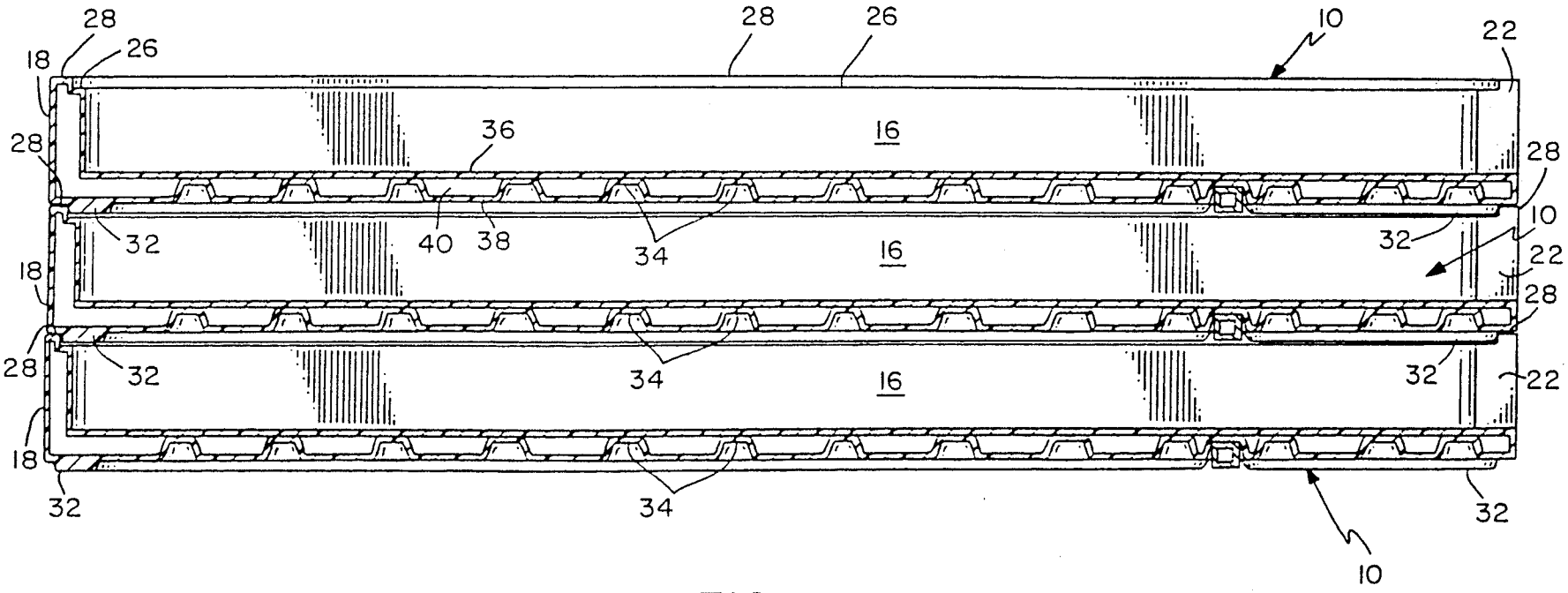
FIG. 3 is a side cross section view of the column of like trays of FIG. 2 taken through line 3—3 of FIG. 2.
Figure 4:
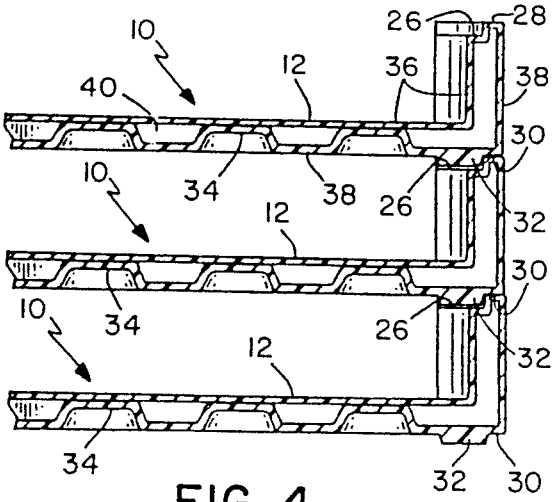
FIG. 4 is a rear detail section view of the column of like trays of FIG. 2 taken through line 4—4 of FIG. 2.

Referring particularly to FIGS. 1, 3, and 4, it may be seen that the side walls 14, 16, rear wall 18, and wall segments forming the front wall 20 define a generally horizontal top edge 26 extending around the periphery of the tray 10 at a uniform height and being generally within a common plane, with the exception of the area comprising the opening 22 which preferably has no structure corresponding to the top edge 26 thereabove.

Figure 9:
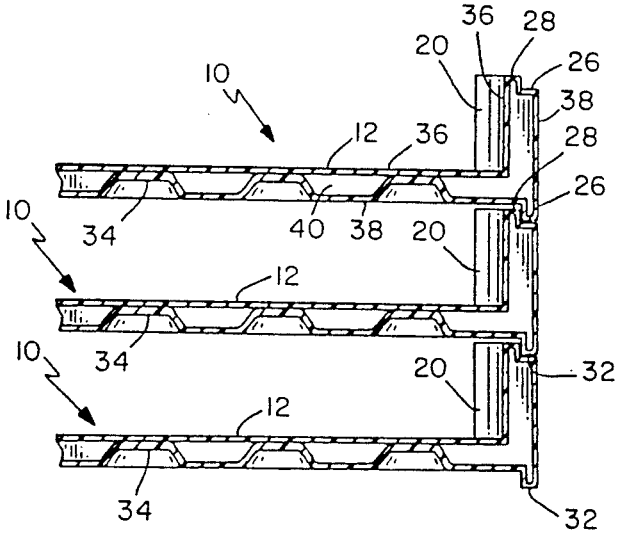
FIG. 9 is a rear detail section view of a column of like trays such as in FIG. 2 taken through a line corresponding to line 4—4 of FIG. 2, the like trays having an alternate embodiment to that of the tray of FIG. 1 in which the relative positions of the top ledge and bottom ledge of each tray is reversed.

Extending generally perpendicularly upward from the top edge 26 around the periphery of the tray 10 and integrally formed therewith is a top ledge 28, the top ledge 28 preferably having a thickness approximately one half the thickness of the top edge 26 and a height of approximately ¼" (0.1 cm) or less. The top ledge 28 is preferably positioned so as to extend along the outer side of the top edge 26 generally aligned and coplanar with the outer surface of each of the adjacent corresponding side walls 14, 16, rear wall 18, and wall segments forming the front wall 20, although the top ledge 28 ma be positioned to extend along the inner side of the top edge 26 generally aligned and coplanar with the inner surface of each of the adjacent corresponding side walls 14, 16, rear wall 18, and wall segments forming the front wall 20 as shown in FIG. 9.

Conversely, the top surface of the top ledge 28 may be thought of as the top edge of each of the side walls 14, 16, rear wall 18, and wall segments forming the front wall 20, and the top edge 26 may be thought of as an open-sided channel extending downwardly from the top surface of the top ledge 28.

The side walls 14, 16 and rear wall 18 preferably form generally curved or arcuate segments at the adjoining or meeting corners thereof, and the side walls 14, 16 and wall segments forming the front wall 20 may similarly form generally curved or arcuate segments at the adjoining or meeting corners thereof. As shown in FIG. 1, the top ledge 28 is similarly curved corresponding to the curvature of the corners such that the generally vertical outer side surface of the top ledge 28 is aligned and coplanar with the generally vertical outer side surfaces of the side walls 14, 16, rear wall 18, and wall segments forming the front wall 20.

Referring to FIG. 4, it may be seen that each of the side walls 14, 16, rear wall 18, and wall segments forming the front wall 20 may be thought of as defining a bottom edge 30 extending around the periphery of the tray 10 at a uniform depth and being generally within a common plane, or conversely the underside surface of the bottom panel 12 may similarly be considered to form the bottom edge 30.

Extending generally perpendicularly downward from the bottom edge 30 of the side walls 14, 16, rear wall 18, and wall segments forming the front wall 20, or from the bottom edge 30 of the bottom panel 12 adjacent to the side walls 14, 16, rear wall 18, and wall segments forming the front wall 20, is a bottom ledge 32. The bottom ledge 32 is preferably curved in the areas corresponding to the corners of the tray 10 adjacent to the junctions between the side walls 14, 16, rear wall 18, and wall segments forming the front wall 20 to match the curvature of the top ledge 28.

The bottom ledge 32 preferably has a thickness approximately one half the thickness of the bottom edge 30 and is preferably positioned so as to extend along the inner or outer side of the bottom edge 30 generally opposing the positioning of the top ledge 28, such that the inner (or outer) surface of the top ledge 28 and the outer (or inner) surface of the bottom ledge 32 lie along or closely adjacent to (but not overlapping) a generally vertical common line at each point along and around the periphery of the tray 10 at which there is a bottom ledge 32 and top ledge 28.

The top ledge 28 preferably has a generally rectangular cross section corresponding in shape, height, and width to the open area adjacent to the bottom ledge 32 and beneath the bottom edge 30, and similarly, the bottom ledge preferably has a generally rectangular cross section corresponding in shape, height, and width to the open area adjacent to the top ledge 28 and above the top edge 26.

As such, when a tray 10 is positioned or stacked on top of and in nested contact with a like tray 10, the bottom ledge 32 of the tray 10 will rest on top of the top edge 26 of the like tray 10 and be bounded or contained by the top ledge 28 of the like tray 10 to form a type of a lap joint between the two trays 10 and prevent the trays 10 from moving horizontally relative to one another. Conversely, as shown particularly in FIG. 9, the positions of the top ledge 28 and bottom ledge 32 of each tray 10 may be reversed relative to one another and when a tray 10 is positioned or stacked on top of and in nested contact with a like tray 10 the bottom ledge 32 of the tray 10 will rest on top of the top edge 26 of the like tray 10 and bound or contain the top ledge 28 of the like tray 10 similarly form a type of a lap joint between the two trays 10.

The top ledge 28 of the tray 10 and the bottom ledge 32 of a like tray 10 thereby form an interlocking mechanism, with the peripherally innermost of the top ledge 28 or bottom ledge 32 comprising a projecting portion extending upwardly from the top or downwardly from the bottom of the tray 10, and the peripherally outermost of the top ledge 28 or bottom ledge 32 comprising a receiving portion sized and positioned along the top or bottom of the tray 10 so as to operatively cooperate with and be received within the projecting portion of a like tray 10 when the tray 10 and like tray 10 are stacked in a vertical column. It may further be appreciated that the projecting portion may comprise one or a plurality of discrete projections received within apertures defined by the top edge 26 or bottom panel 12 to interlock the tray 10 and like tray 10 against horizontal movement, or may comprise a lap joint of a type different than that shown herein as the preferred embodiment, such as a top ledge 28 and bottom ledge 32 having an irregular, unsymmetrical, or nonuniformly sized cross section or having gaps or discontinuities along the top edge 28 or bottom edge 30.

Figure 8:
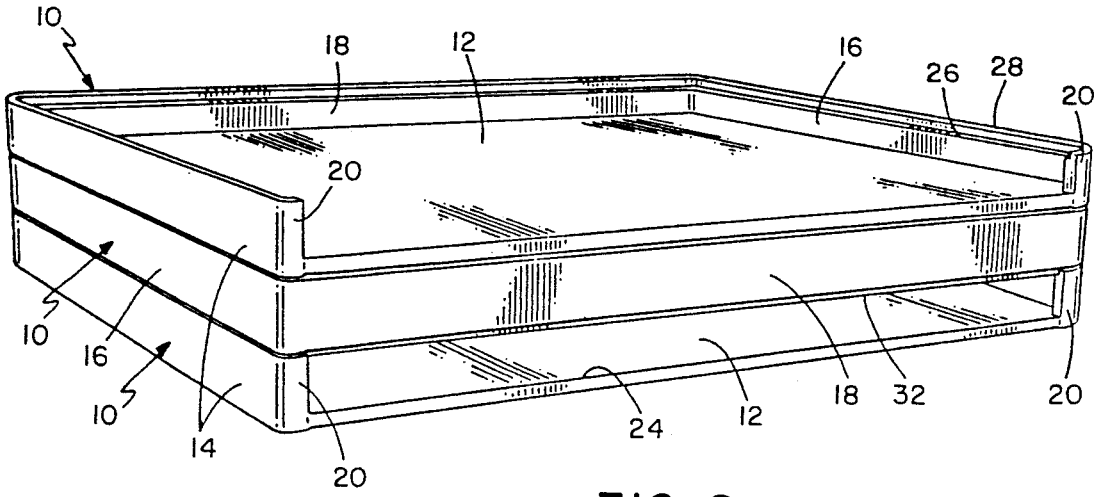
FIG. 8 is a front perspective view of a plurality of trays of FIG. 1 stacked in a vertical column with the center tray in the column facing rearwardly.

Referring to FIGS. 2 and 8, it may be seen that each of the trays 10 have uniform lengths and widths such that the trays 10 may be stacked on like trays 10 such that the openings 22 of each tray 10 face in the same forward direction as shown in FIG. 2, or with the orientation of the opening 22 of any one tray 10 reversed by 180° relative to any other tray 10 in a predetermined alternating or random order as shown in FIG. 8. Each tray 10 preferably has a length generally greater than the width thereof, however the trays 10 may be sized such that the lengths and widths are equal and the trays 10 are square, thereby permitting the openings 22 to be oriented at multiples of 90° angles relative to the openings 22 of the like trays 10 stacked in the column.

Figure 5:
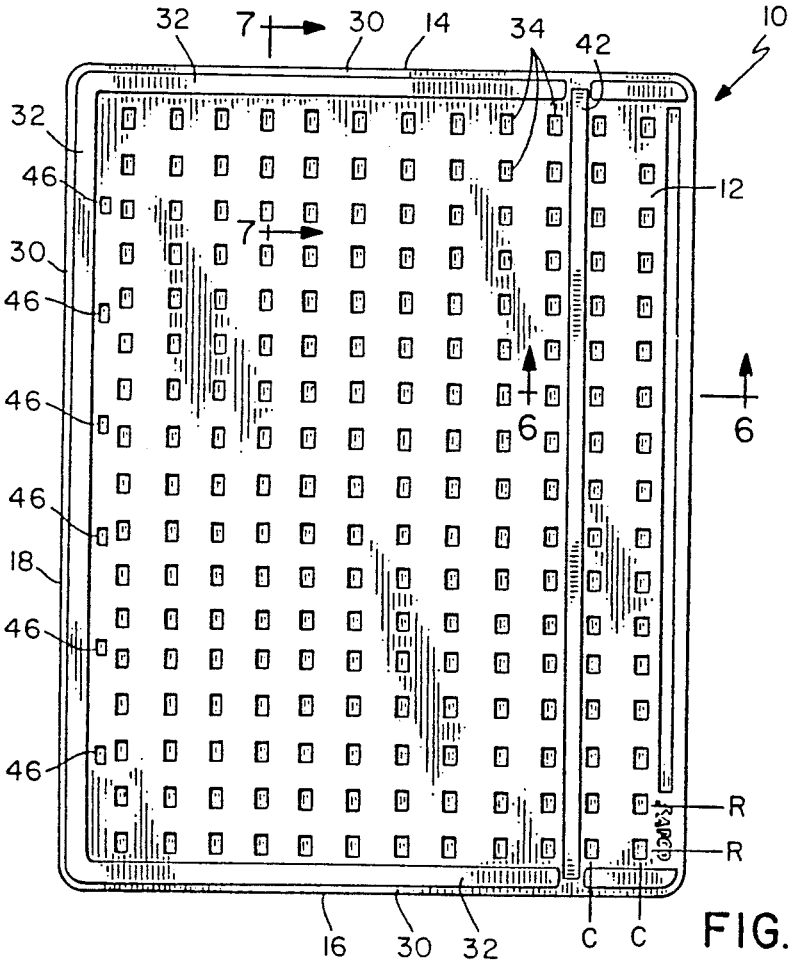
FIG. 5 is a bottom plan view of the one embodiment of the tray of FIG. 1 incorporating a transverse front cross brace.

Referring to FIGS. 3 and 5, it may be seen that the bottom panel 12 defines a waffle pattern comprised of and formed by an array of generally square recesses 34 extending upwardly into the bottom panel 12 from the underside surface thereof, each recess 34 having a depth approximately equal to one half the thickness of the bottom panel 12. The array of recesses 34 preferably comprises approximately two hundred recesses 34 aligned in a plurality of generally straight rows R extending perpendicularly with the opposing side walls 14, 16 of the tray 10 and a plurality of generally straight columns C extending perpendicularly with the rear wall 18 of the tray 10. The length of each side of the recesses 34 is slightly less than the distance between adjoining recesses 34, with the distance between adjoining rows R and columns C of recesses 34 being generally equal to one another.

Each tray 10 is preferably blow or injection molded from a plastic such as an opaque ultra-high molecular weight high density polyethylene. Referring to FIGS. 3, 4, 6, 7, and 9, it may be seen that each of the bottom panel 12, side walls 14, 16, rear wall 18, and front wall segments of the front wall 20 are constructed from an inner shell segment 36 and an outer shell segment 38 (or upper shell segment 36 and lower shell segment 38, respectively, in the case of the bottom panel 12) generally spaced apart from one another by a hollow cavity 40. The lower shell segment 38 of each square recess 34 extends upwardly to a point proximate or closely adjacent to the upper shell segment 36 of the bottom panel 12, and may in some cases be in parallel abutting contact with the upper shell segment 36 to provide additional support therefore.

Figure 6:
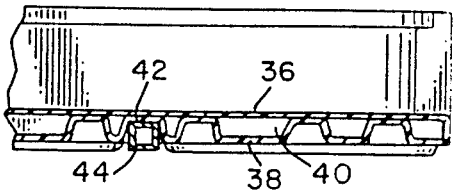
FIG. 6 is a front detail section view of the tray of FIG. 5 taken through line 6—6 of FIG. 5.
Figure 7:
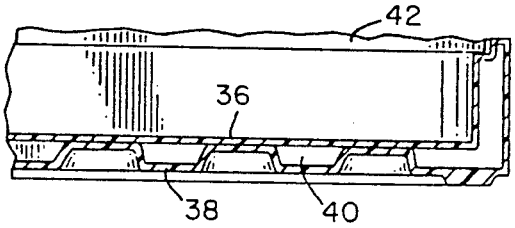
FIG. 7 is a side detail section view of the tray of FIG. 5 taken through line 7—7 of FIG. 5.

Referring particularly to FIGS. 5 and 6, it may be seen that in one alternate embodiment of the stackable tray 10, a cross brace 42 traverses laterally across and proximate to the front each tray 10 generally parallel thereto and is received within a generally rectangular lateral recess 44 formed in the underside or lower shell segment 38 of the bottom panel 12. Each cross brace 42 is fabricated from a tubular metal shaft having a generally square cross section.

In a further alternate embodiment of the stackable tray 10 as shown in FIG. 5, a plurality of additional rear recesses 46 or feet may be positioned and dispersed along and proximate to the rear wall 18 of the stackable tray 10 but generally out of alignment with the rows and columns of recesses 34. The rear recesses 46 are defined by the underside or lower shell segment 38 of the bottom panel 12, the lower shell segment 38 of each rear recess 46 similarly extending upwardly to a point proximate or closely adjacent to the upper shell segment 36 of the bottom panel 12.

The stackable tray 10 as described more fully herein with the cross brace 42 provides the capacity of holding approximately 75 lbs. (34 kg.) of paper with a ½" or less deflection of the bottom panel 12, with a column of ten like trays 10 each being capable of holding approximately 40 lbs. (18 kg.) of paper when in the stacked column configuration. Each tray 10 itself weighs approximately 12-13 lbs. (5.5-6 kg.) including the cross brace 42.

While the preferred embodiments of the above stackable tray 10 have been described in detail with reference to the attached drawing FIGURES, it is understood that various changes and adaptations may be made in the stackable tray 10 without departing from the spirit and scope of the appended claims.

What is claimed is:

1. A tray which may be stacked with a like tray in a vertical column said tray and said like tray each being molded from a plastic material, said tray comprising:

a bottom panel, said bottom panel having a pair of opposing side edges, a front edge, and a rear edge defining a periphery of the tray, said bottom panel being generally planar and being oriented generally horizontally, said bottom panel defining a bottom of the tray;

a pair of opposing side walls, each of said pair of opposing side walls being connected to and extending generally upward from said bottom panel and positioned adjacent to a one of said pair of opposing side edges of said bottom panel;

a rear wall, said rear wall being connected to and extending generally upward from said bottom panel and positioned adjacent to said rear edge of said bottom panel, said pair of side walls and said bottom panel defining an opening, said pair of side walls, said rear wall, and said bottom panel defining an interior region and a top of the tray, said bottom panel, said pair of side walls, and said rear wall each include an inner shell segment and an outer shell segment confronting and spaced apart from said inner shell segment by a cavity;

an interlocking mechanism, said interlocking mechanism including a projecting portion extending upwardly from the top of the tray or downwardly from the bottom of the tray, said interlocking mechanism further including a receiving portion sized and positioned along said top of the tray or said bottom of the tray so as to operatively cooperate with said projecting portion of said interlocking mechanism, whereby the tray may be placed on top of and in contact with the like tray such that the bottom panel of the tray and the opposing side walls and rear wall of the like tray substantially enclose the like tray except for the opening defined thereby, and whereby the projecting portion of the interlocking mechanism of the tray will closely confront and operatively communicate with the receiving portion of the interlocking mechanism of the like tray to prevent the tray and the like tray from moving horizontally relative to one another.

2. The tray of claim 1 further comprising:

a front wall, said front wall including a pair of front wall segments, each of said pair of front wall segments being spaced apart from one another and disposed adjacent to one of the opposing side edges of the bottom panel, the opening being disposed between said pair of front wall segments and above the bottom panel.

3. The tray of claim 1 wherein at least a portion of the top ledge is curved and wherein at least a corresponding portion of the bottom ledge is similarly curved.

4. The tray of claim 1 wherein the opposing side walls are spaced apart from one another a distance of approximately 42".

5. The tray of claim 1 wherein the rear wall is spaced apart from the front edge of the bottom panel a distance of approximately 32".

6. The tray of claim 1 wherein the bottom panel has a generally planar surface defining a plurality of recesses therein.

7. The tray of claim 6 wherein the plurality of recesses are disposed in an array of generally parallel aligned rows and columns.

8. The tray of claim 1 wherein the tray is fabricated as an integral unit.

9. The tray of claim 8 wherein the tray is molded from ultra high molecular weight high density polyethylene.

10. The tray of claim 1 wherein the opening of the tray and the opening of the like tray may be oriented facing in opposite directions relative to one another when the tray is stacked on the like tray.

11. The tray of claim 1 wherein the bottom panel has a generally planar surface defining a plurality of recesses therein, said plurality of recesses each being defined by the outer shell segment of the bottom panel.

12. The tray of claim 11 wherein the outer shell segment of each recess extends upwardly to a point generally proximate to the inner shell segment of the bottom panel.

13. The tray of claim 1 wherein the tray further includes a cross brace said cross brace being connected to the bottom panel and extending across the tray, said cross brace further preventing the bottom panel from bending proximate to the interior region or the opening of the like tray when a stack of paper stock or drawings sheets is placed within the interior region of the tray.

14. The tray of claim 13 wherein the bottom panel further defines a transverse recess extending generally across the bottom panel between the opposing sides of the tray generally proximate to the opening, said transverse recess receiving at least a portion of the cross brace therein such that the cross brace contacts the like tray on which the tray is stacked in the vertical column proximate to the opposing side walls thereof.

* * * * *